United States Patent [19]

Wössner

[11] 3,962,869

[45] June 15, 1976

[54] EQUIPMENT FOR EXHAUST GAS DETOXIFICATION IN INTERNAL COMBUSTION ENGINES

[75] Inventor: Günter Wössner, Esslingen, Germany

[73] Assignee: Robert Bosch G.m.b.H., Stuttgart, Germany

[22] Filed: Aug. 28, 1973

[21] Appl. No.: 392,311

[30] Foreign Application Priority Data

Sept. 4, 1972 Germany ..... 2243428

[52] U.S. Cl. ..... 60/298; 23/288 F; 60/300; 165/105

[51] Int. Cl.[2] ..... F01N 3/14

[58] Field of Search ..... 60/303, 298, 320, 299, 60/300; 23/288 FR; 165/105

[56] References Cited

UNITED STATES PATENTS

| | | | |
|---|---|---|---|
| 1,893,372 | 1/1933 | Kryzanowsy | 60/298 |
| 3,414,475 | 12/1968 | Fiebelmann | 165/105 |
| 3,604,503 | 9/1971 | Feldman | 165/105 |
| 3,662,542 | 5/1972 | Streb | 60/320 |
| 3,712,053 | 1/1973 | Kofink | 165/105 |
| 3,737,286 | 6/1973 | Kofink | 60/303 |
| 3,826,089 | 7/1974 | Nakajima | 60/301 |

*Primary Examiner*—Douglas Hart
*Attorney, Agent, or Firm*—Edwin E. Greigg

[57] ABSTRACT

An insulated heat pipe is provided which transfers heat from the engine's exhaust manifold to an exhaust gas reactor. The heat pipe contains a first zone serving as an evaporation zone, a second zone serving as a transport zone for transporting a working medium between the first zone and a third zone. The third zone serves as a condensation zone. The heat pipe has an interior capillary tube along which the condensed heat transfer medium flows toward the heat source and within which the vaporized medium flows toward the heat sink.

3 Claims, 8 Drawing Figures

EQUIPMENT FOR EXHAUST GAS DETOXIFICATION IN INTERNAL COMBUSTION ENGINES

BACKGROUND OF THE INVENTION

The present invention relates to equipment for the exhaust gas detoxification of internal combustion engines including at least one thermal or catalytic reactor within the exhaust system.

It is well known in exhaust gas systems that the part of the system which includes the reactor is located remote from the internal combustion engine itself in order to avoid exhaust gas heat being transferred back to the internal combustion engine which would impair its cooling; in addition, there is rarely enough space for mufflers or reactors within the engine compartments of motor vehicles. In such an arrangement, the exhaust gas has normally cooled off somewhat when it reaches the reactor, resulting in inefficient operation of the reactor especially during the warm-up phase of the internal combustion engine. Furthermore, the difference between the inlet and outlet gas temperatures of the reactor is quite high which, when applied to the entire thermal operating region, leads to considerable thermal stresses in the material as well as to a non-uniform treatment of the exhaust gas.

OBJECTS OF THE INVENTION

It is, therefore, an object of the present invention to provide exhaust gas detoxification equipment of the above type wherein the reactor temperatures are similarly as high as those which prevail in the exhaust manifold of the engine.

It is a further object of the present invention to provide a favorable temperature equalization within the reactor.

It is a still further object of the present invention to achieve, by simple means, a favorable operating temperature in the reactor during the warm-up phase of the internal combustion engine.

SUMMARY OF THE SEVERAL EMBODIMENTS OF THE INVENTION

The above and other objects are achieved according to the present invention in that the regulation of the heat distribution is accomplished by means of a heat pipe having three sequential zones: an evaporation zone; a transport zone thermally insulated with respect to the outside; and a condensation zone. The heat pipe further contains a radially permeable capillary inner tube which internally conducts the working medium in vapor form streaming toward the condensation zone and externally helps to conduct the working medium in liquid form to flow towards the evaporation zone. Heat is absorbed by the fluid working medium in the evaporation zone of the heat pipe and is transported nearly isothermally to the condensation zone in the reactor where the working medium condenses and subsequently flows back to the evaporation zone as a consequence of capillary forces (surface tension) within the capillary tube. By the use of such a heat pipe it is possible to achieve a relatively high heat transport rate at practically constant temperature. The device described is a heat flow transformer which operates independently of the existence of a gravitational field.

According to a favorable embodiment of the present invention, the region of the heat pipe containing the evaporation zone is located in the vicinity of the exhaust valves of the internal combustion engine, whereas the region of the heat pipe containing the condensation zone is disposed within the reactor. It is advantageous to make the region of the heat pipe containing the transport zone flexible and especially to conduct it outside of the exhaust pipe. By a suitable development of the heat pipe within the reactor, it is possible to reduce the temperature gradient within the reactor material both in the axial or stream direction as well as in the radial direction, because the temperature drop within the heat pipe is very small even in the condensation zone. In order to achieve a favorable temperature compensation, the region of the heat pipe containing the condensation zone can be equipped, on the side exposed to the exhaust gas, with heat conducting guide surfaces, such as ribs, fins, sheet metal cells, flow-reversing vanes and the like, in thermal contact with and disposed both longitudinally and transversely to the heat pipe. The effect of these additional elements is further enhanced if, according to the invention, at least one secondary heat pipe is provided in the exhaust system, especially if developed as fins on the primary heat pipe. In that case, the region of the secondary heat pipe containing the evaporation zone should be in thermal contact with the region of the primary heat pipe containing its condensation zone.

In order to achieve favorable operation of the reactor and especially in order to avoid overheating, the heat pipe can function as a temperature regulator. To this end, according to a further embodiment of the invention, the length of the effective condensation region is alterable. For this purpose, the heat pipe can be connected, at the end which lies opposite the evaporation zone, with a container filled with, especially, noble gas. In that way, a separation zone is formed transversely to the axis of the heat pipe, between the active condensation zone and the noble gas zone. The temperature regulation makes it possible to use only a minimum of catalyst material because the working surfaces can be made smaller on account of the improved temperature equalization. When a noble gas is used, the temperature within a certain range remains constant and independent of the amount of heat transported at a value where the vapor pressure corresponding to this temperature is equal to the noble gas pressure. A change in the amount of heat transported, therefore, only produces an axial shift of the separation zone between the working medium and the noble gas, and therefore causes a change of the length of the effective condensation region of the heat pipe (the surface giving off heat). If the gas pressure is unchanged, however, then the temperature of the heat pipe also remains unchanged. An ideal gas container would be infinitely large and for this reason, according to the invention, the volume of the gas is changeable and the container is preferably made in the form of a folding bellows, but other displacement bodies can be used. The regulation can be further influenced in that, according to the invention, the condensation region of the heat pipe partially protrudes out of the reactor and is preferably provided at this free end with cooling fins. During a suitable temperature change, the separating zone migrates into this protruding region, thereby accelerating the process of condensation.

Another embodiment of the present invention provides, for the purpose of heat regulation, a second, independently acting heat pipe within the exhaust system. The primary heat pipe serves for heating the reactor and is especially developed as a double coaxial pipe where the annular space enclosed by the pipes contains the working zone. The second heat pipe is located so that, for purposes of temperature regulation, its evaporating region extends into the inner pipe of the primary heat pipe which carries exhaust gas.

According to yet another embodiment of the present invention, a heat pipe in the form of a double-walled pipe surrounds the reactor in sleeve-like fashion and its evaporation zone is in thermal contact especially with the reactor working surface, whereas its condensation zone is exposed to ambient air.

If the working medium is suitably chosen, the reactor transports heat to the outside only after it has achieved a favorable working temperature. The working medium could be, for example, sodium which has a boiling point of 882° C. Only when this temperature is reached does sodium begin to evaporate and above this temperature, the heat pipe transports heat to the outside by means of its condensation zone. In this process, use is made especially of the fact that, during the transition from the solid to the liquid state of an element (for example, sodium, potassium) or of a compound (salts and the like) as well as during a transition from the liquid to the gaseous state, isothermal conditions (constant temperature) prevail during the heat transport process until the entire working medium has achieved the new state of aggregation. Because a solid salt, for example, is a poor heat conductor, the heat pipe acts as a thermal insulator with respect to the outside (radiation shield).

DESCRIPTION OF THE PREFERRED EMBODIMENTS

Figure 1:
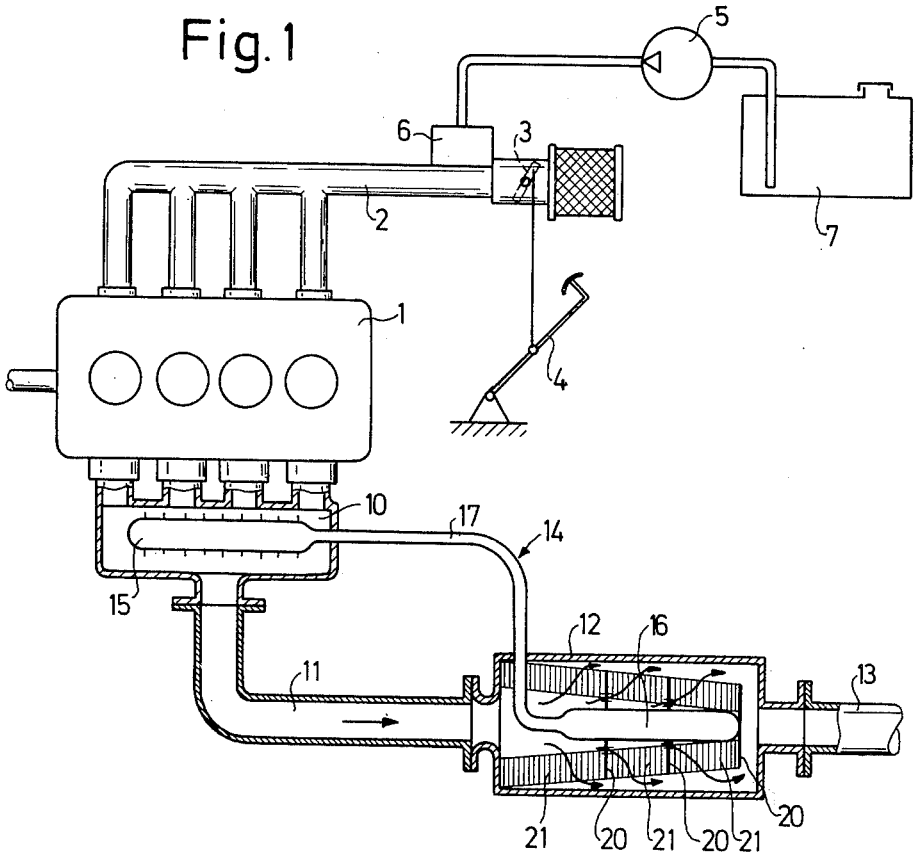
FIG. 1 illustrates a schematic layout of an internal combustion engine including exhaust gas detoxification equipment according to one embodiment of the present invention.
Figure 2:
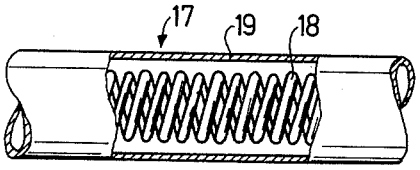
FIG. 2 is a partial cross-sectional view which illustrates the transport zone of the heat pipe according to one embodiment of the present invention.

Referring now to FIG. 1, a first embodiment of the invention shows an internal combustion engine 1 supplied with air through a suction tube 2 whose free passage is controlled by a throttle flap 3 actuated by a gas pedal 4. A fuel supply pump 5 and a fuel metering assembly 6 cause fuel from a tank 7 to be added to the intake air. The exhaust gases of the engine 1 are gathered in an exhaust manifold 10 and are led through an exhaust pipe 11 to a reactor vessel 12. Within the reactor vessel 12, a final combustion of the uncombusted remnants in the exhaust gas takes place, and the exhaust gas then continues through a pipe 13 to the atmosphere. In order to transfer the high exhaust gas temperature prevailing in the exhaust manifold 10 to the reactor 12, a heat pipe 14 is provided. The heat pipe 14 has three regions, namely, an evaporation region 15, a condensation region 16 and a flexible transport region 17. The heat pipe 14 is disposed in such a way that its evaporation region 15 lies within the exhaust manifold 10 and its condensation region 16 lies within the reactor 12. Between regions 15 and 16 extends the flexible transport region 17 which can lie outside of the exhaust system and which is thermally insulated from the atmosphere. This flexible region 17 is shown enlarged in FIG. 2 where a capillary inner tube is shown formed by a helically wound wire 18. The outer jacket 19 is constructed from suitable thermally insulating material. A wire mesh tube or a wick or the like may be used instead of the helical wire tube. In order to achieve a favorable heat distribution and heat conduction, region 16 in FIG. 1 is provided with ribs 20 between which metal sheets in the form of fins 21 are disposed whose surfaces are covered with an evaporated catalytic material, for example, platinum, and around which exhaust gas flows as shown by the arrows. The fins 21 are stacked as shown and mounted to the ribs 20 in a conventional manner.

Figure 3:
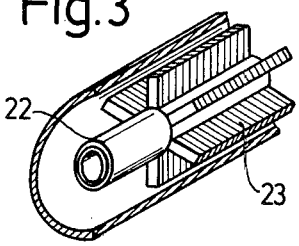
FIG. 3 is an isometric view partly in cross section illustrating the condensation zone of the heat pipe according to one embodiment of the present invention.
Figure 4:
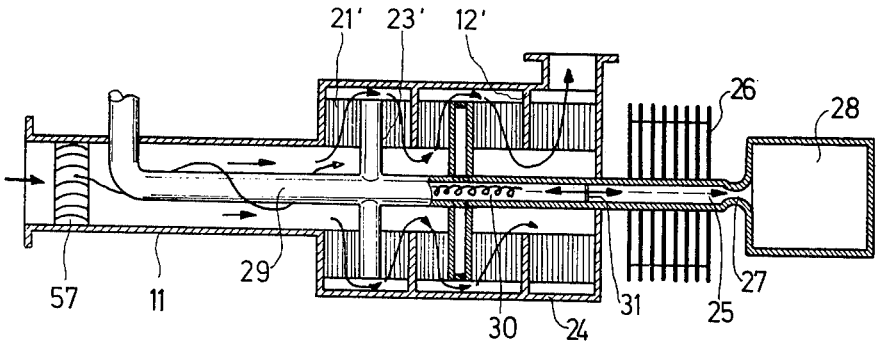
FIG. 4 is a view partly in cross section illustrating a reactor including the condensation zone of the heat pipe according to another embodiment of the present invention.
Figure 5:
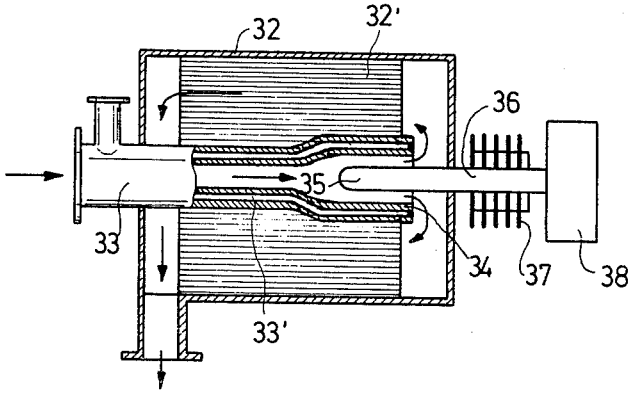
FIG. 5 is a view partly in cross section illustrating a reactor including the condensation zone of the heat pipe according to yet another embodiment of the present invention.

By a further embodiment shown in FIGS. 3, 4 and 5, an improvement of the heat transfer process can be achieved by providing, in addition to the primary heat pipe already described, several secondary heat pipes whose evaporation region is in positive thermal contact with the condensing region of the primary heat pipe. In FIG. 3, the condensation region 22 of the primary heat pipe is provided with radially extending secondary heat pipes 23 whose evaporation region is fixedly connected with the region 22. The secondary heat pipes 23 can either be installed in the form of many small pipes whose longitudinal axes extend radially from the axis of condensation region 22 or they can be disposed parallel to that axis. In either case, each secondary heat pipe has its own capillary tube and operates as a closed system.

FIG. 4 shows a reactor 24 and a region 25 of the heat pipe 29 which extends out of the reactor 24 and is provided with cooling fins 26. This end of the heat pipe 29 communicates through a pipe section 27 with a container 28 filled with noble gas. As in the heat pipes previously described, the operating medium of the heat pipe is evaporated in the evaporating region which is not shown in FIG. 4 and flows within the heat pipe 29 to the reactor 24 and from there to the region 25 where it undergoes condensation. The condensate is subsequently carried back to the evaporator under the influence of capillary forces due to the capillary tube 30.

Between the zone of condensation in the heat pipe 29 and the noble gas there is formed a relatively sharp separation in the form of a separating layer 31. A change in the amount of heat carried causes only a shift of the zone of separation between the working medium and the noble gas, resulting in a change of the effective heat-exchange surface area in the condensation region of the heat pipe. Now, if the amount of heat transported changes, but the gas pressure remains unchanged, then the temperature of the heat pipe also remains unchanged. Hence, within a certain temperature range, and independently of the transported amount of heat, the temperature of the heat pipe 29 adjusts itself so that the vapor pressure of the medium corresponding to that temperature is equal to the gas pressure.

In the embodiment of FIG. 4, the exhaust pipe 11 is provided as shown with flow-scoops 57 which produce a turbulent flow of the exhaust gas as it approaches the reactor 24. In the reactor 24 there is provided secondary heat pipes 23' similar to those described for the embodiment of FIG. 3. Also, the reactor 24 is provided with ribs 12' between which the fins 21' are mounted to effect the purpose described in the embodiment of FIG. 1 with respect to the fins 21.

FIG. 5 shows a reactor 32 in which a heat pipe 33 is developed as a double-walled pipe through whose inner pipe 34 exhaust gas is admitted and is then reversed and flows through the catalyzer region 32' and, finally, around the exterior of the heat pipe 33 and beyond. A capillary tube is disposed in the space 33' between the pipes 33 and 34. For the sake of clarity, however, this capillary tube is not shown. Nevertheless, it should be noted that this capillary is similar to that already described. An evaporation region 35 of a second heat pipe extends into the inner pipe 34 from the terminal side of the condensation region 36 and is developed as the sensing finger of the evaporation region 35 of a second heat pipe. The condensation region 36 of the second heat pipe, which is equipped with cooling fins 37, partially protrudes from reactor 32 and communicates with a gas container 38. In this way, the temperature of the exhaust gas streaming through the inner pipe 34 can be held within certain limits before it reaches the catalyst because of the variable heat transfer rate to the secondary heat pipe.

Figure 6:
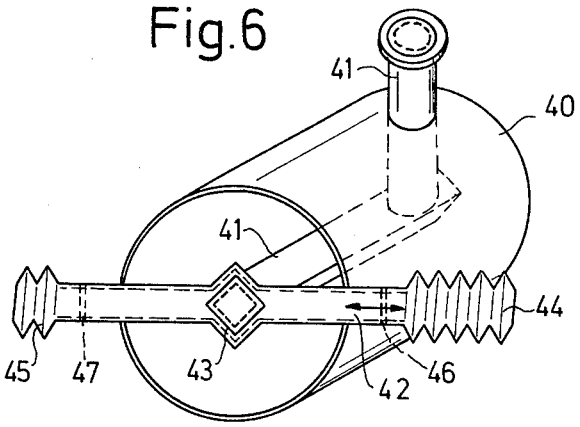
FIG. 6 is an isometric view of still another embodiment according to the present invention illustrating a reactor and a primary and secondary heat pipe disposed transversely to each other.

In a further embodiment depicted in FIG. 6, a reactor 40 is shown having a primary heat pipe 41 and a transverse secondary heat pipe 42. The primary and the secondary heat pipes have a thermally conducting connection at their intersecting region 43. On both of its end sections, the secondary heat pipe 42 is equipped with folding bellows 44 and 45 which are filled with different noble gases, making possible a different temperature control. The evaporation region of the secondary heat pipe 42 lies at the intersecting region 43 whereas the condensation regions lie at the folding bellows 44 and 45. A separating layer 46, 47 is formed between each noble gas and the working medium. By external mechanical means, the gas pressure in the bellows 44 and 45 may be changed in order to further influence the temperature regulation.

Figure 7:
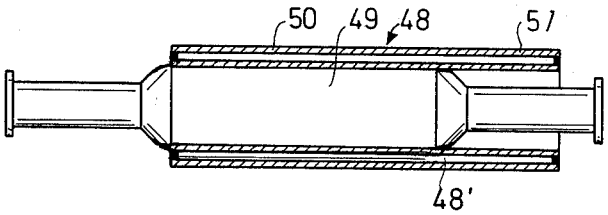
FIG. 7 illustrates partly in cross section still another embodiment according to the present invention according to which the heat pipe surrounds the reactor in sleeve-like fashion.

In order to rapidly achieve a favorable operating temperature of the reactor, and in order to avoid having too much heat carried off to the outside, there is disposed, in a further exemplary embodiment shown in FIG. 7, a heat pipe 48 which surrounds the reactor 49 in a sleeve-like fashion. This heat pipe is provided either as an addition to or independently of the previously described heat pipe leading to the exhaust tube manifold. This heat pipe 48 is preferably filled with a working medium which is a solid at temperatures lower than a favorable reactor operating temperature and which becomes a liquid or a gas in the favorable operating temperature range. Suitable materials for such media are, for example, several salts, such as strontium fluoride, potash, soda, potassium fluoride, lithium fluoride, sodium chloride etc., as well as pure metals, such as sodium and potassium; in any case, media whose melting point or vaporization point lies in the region of the optimal operating temperature of the reactor, here for example between 800° and 900° C. Only the evaporation region (or melting region) 50 of the heat pipe 48 is in contact with the reactor 49, whereas the condensation region 51 (or fluid zone) is cooled by ambient air. As long as the favorable operating temperature has not been reached, the working medium acts as a thermal insulator or heat shield (the solid material acting as the insulating material). However, when the melting or vaporizing temperature in the working medium has been surpassed, and before temperatures might be reached which would endanger the material in the reactor, the fluid circulating within the heat pipe lowers the higher temperature by heat transport. Just as is the case for the main heat pipe 34 in FIG. 5, the heat pipe 48 is embodied as a double-walled pipe wherein a capillary pipe is disposed in the space 48' between the inner and outer walls.

Figure 8:
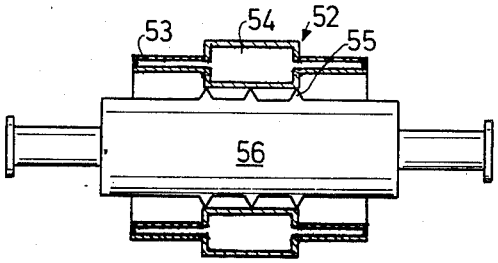
FIG. 8 illustrates partly in cross section still another embodiment according to the present invention according to which the heat pipe surrounds the reactor with a condensation region at each end thereof with the evaporation zone therebetween.

Another exemplary embodiment shown in FIG. 8 operates on the same principle as does that shown in FIG. 7. In contrast thereto, heat pipe 52 has a condensation region 53 at each end, whereas the evaporation region 54 communicates with reactor 56 through the action of heat contact bridges 55 onto which it is press-fit.

That which is claimed is:

1. In equipment for exhaust gas detoxification of internal combustion engines of the type that includes an exhaust system with an exhaust manifold and an exhaust pipe and at least one thermal or catalytic reactor within the exhaust system, the improvement comprising: a heat pipe within which a working fluid flows, said heat pipe containing three zones, a first zone serving as an evaporation zone, said evaporation zone being disposed in the vicinity of the exhaust valves of the internal combustion engine for accepting heat from the exhaust gas, a second zone serving as the transport zone for the transport of the working medium between the first and third zones, said second zone being of flexible construction, extending along the outside of the exhaust pipe and having insulating material surrounding the outer surface of the respective portion of the heat pipe to substantially prevent heat flow from the second zone to its surroundings, and a third zone serving as a condensation zone and giving off heat to its surroundings, said condensation zone being disposed within the reactor; and a radially permeable capillary tube formed as a helically wound wire lying within the heat pipe such that through and along its interior the working medium flows in a vapor phase towards the condensation zone and along its outside the working medium flows in a liquid phase toward the evaporation zone.

2. The equipment as defined in claim 1, wherein the region of the heat pipe containing the condensation zone is equipped, on the side exposed to the exhaust gas, with heat-conducting guide surfaces in thermal contact with and disposed both longitudinally and transversely to the heat pipe, and wherein said guide surfaces are covered with a layer of evaporated catalytic material, in particular platinum.

3. The equipment as defined in claim 1, further comprising a secondary heat pipe in the form of a rib whose region containing the evaporation zone is thermally connected to the condensation region of the primary heat pipe.

* * * * *